United States Patent [19]

Heath

[11] 4,328,867

[45] May 11, 1982

[54] FIRE EXTINGUISHERS

[75] Inventor: Richard C. Heath, Surrey, England

[73] Assignee: Clifford Edwards Limited, Sussex, England; a part interest

[21] Appl. No.: 68,345

[22] Filed: Aug. 21, 1979

Related U.S. Application Data

[63] Continuation-in-part of Ser. No. 853,657, Nov. 21, 1977, Pat. No. 4,194,569.

[30] Foreign Application Priority Data

Nov. 22, 1976 [GB] United Kingdom ..... 48658/76

[51] Int. Cl.[3] ..... A62C 37/28

[52] U.S. Cl. ..... 169/58; 169/28

[58] Field of Search ..... 169/58, 56, 60, 61, 169/26, 28, 29

[56] References Cited

U.S. PATENT DOCUMENTS

| | | | |
|---|---|---|---|
| 2,736,386 | 2/1956 | Klompar | 169/58 |
| 2,760,586 | 8/1956 | Reddan | 169/58 X |
| 3,446,287 | 5/1969 | Hook | 169/28 |
| 3,523,583 | 8/1970 | Poitras et al. | 169/28 |
| 3,684,021 | 8/1972 | Poitras | 169/28 |
| 3,874,458 | 4/1975 | Williams | 169/28 X |
| 3,986,560 | 10/1976 | Heath et al. | 169/61 |

FOREIGN PATENT DOCUMENTS

| | | | |
|---|---|---|---|
| 166088 | 10/1953 | Australia | 169/58 |
| 1121521 | 7/1968 | United Kingdom | 169/58 |

*Primary Examiner*—Robert W. Saifer

*Attorney, Agent, or Firm*—Sherman & Shalloway

[57] ABSTRACT

A fire extinguisher of the type comprising a burstable container adapted to provide a high mass flow rate of discharged extinguishant is provided with venting means so adapted to direct the flow of extinguishant from the container that the reaction forces upon the container during discharge of extinguishant compensate one another to minimize the resultant force upon the container. The venting means comprise at least one diaphragm burstable by a detonator device housed in a frangible well which extends into the container.

11 Claims, 7 Drawing Figures

FIRE EXTINGUISHERS

This application is a Continuation-in-Part of my earlier application Ser. No. 853,657, filed on Nov. 21, 1977, and now U.S. Pat. No. 4,194,569.

BACKGROUND OF THE INVENTION

In fire suppression systems requiring a high mass flow rate of extinguishant, for example in order to quench an incipient fire in the presence of a highly volatile liquid fuel, it is known to achieve the required rapid discharge of extinguishant from a container by opening a relatively large bursting diaphragm fitted to a venting port of the container, thus permitting the contents to be ejected either by the vapor pressure of the extinguishant, or by the pressure derived from other means, for example an additional gas filling. Burstable containers of this kind have been proposed for use, for example, in aircraft fire suppression systems. However, such burstable containers have the disadvantage that the high mass flow rate of the fire extinguishant discharged therefrom can cause unduly high reaction forces to be imposed upon the container and thus upon the mountings by which it is secured in, for example, an aircraft, which reaction forces may possibly lead to failure of the mountings and damage to the adjacent structure of the aircraft.

Moreover, difficulties can arise as a result of the diaphragms bursting into awkwardly sited places.

Further difficulties can be encountered in pressurising the containers which also house detonators for bursting the diaphragms, and in replacing the detonators after prolonged periods during which the extinguishers have not been operated.

Yet further difficulties can arise due to accidental operation of the extinguishers.

SUMMARY OF THE INVENTION

It is an object of the present invention to eliminate, or at least to reduce, the above-mentioned disadvantages and difficulties involved with the known fire extinguishers referred to.

The present invention firstly provides a fire extinguisher comprising a container providing a source of extinguishant, a burstable diaphragm defining a part of said container and permitting, upon bursting thereof, a high mass flow rate of extinguishant from the container, wall means arranged in spaced, facing relationship to said diaphragm and being at least substantially equal in area to said diaphragm whereby said wall means provides an impingement surface for a jet of extinguishant released upon bursting of said diaphragm, and means locating said wall means in fixed relation to said container whereby the reaction force upon said container due to the discharge of the jet of extinguishant therefrom is substantially balanced by the reaction force on said wall means due to the impingement of the jet extinguishant thereon, the said locating means defining lateral outlet means between said diaphragm and said impingement surface, and said outlet means extending over the major part of the peripheral space between said diaphragm and said impingement surface and constituting means permitting substantially unimpeded and balanced dispersal of extinguishant deflected by said impingement surface. Thus the resultant force upon the container is reduced or eliminated.

The present invention moreover provides a fire extinguisher comprising a container providing a source of extinguishant, a burstable diaphragm which has a center and defines a part of said container and which permits, upon bursting thereof, a high mass flow rate of extinguishant from the container, and venting means including a number of axial pillars which define a plurality of discharge orifices through which extinguishant flowing from the burstable part of the container may be discharged, the number, size and position of the said discharge orifices being balanced in such a manner that the reaction forces upon the container due to the flow of extinguishant from the discharge orifices substantially balance one another, and said diaphragm being formed with a number of lines of weakness which extend outwardly from said center and which promote bursting of said diaphragm into segments, said lines corresponding in number to and being substantially staggered in position in relation to said pillars which will thus be engaged by the segments on bursting of the diaphragm and blocking of said discharge orifices by said segments will be minimised.

The present invention further provides a fire extinguisher comprising a container having a wall which defines a chamber for a source of extinguishant and which has an opening, means which are burstable by a detonator device in the container and form part of said container and which permit, upon bursting thereof, a high mass flow rate of extinguishant from the container, venting means through which extinguishant flowing from the burstable part of the container may be discharged, and a frangible well extending inwardly from said opening in the container wall to seal said chamber for the extinguishant and to receive said detonator device. Thus, the chamber can be filled with extinguishant and pressurized before, and independently of, insertion of the detonator device, and a detonator device which may have deteriorated after a prolonged period of use can be replaced without depressurising the chamber.

According to a further feature of the present invention, the extinguisher is actuated by a detonator operated through an electrical circuit, which may be energised by a piezo-electric or other self-generating source, and said electrical circuit includes a transformer and an RF filter to minimise the danger of accidental operation on receipt of a pulse or signature generated by such extraneous sources as lightning and radar.

BRIEF DESCRIPTION OF THE DRAWINGS

The invention is illustrated by way of example in the accompanying drawings in which.

DESCRIPTION OF PREFERRED EMBODIMENTS

Figure 1:
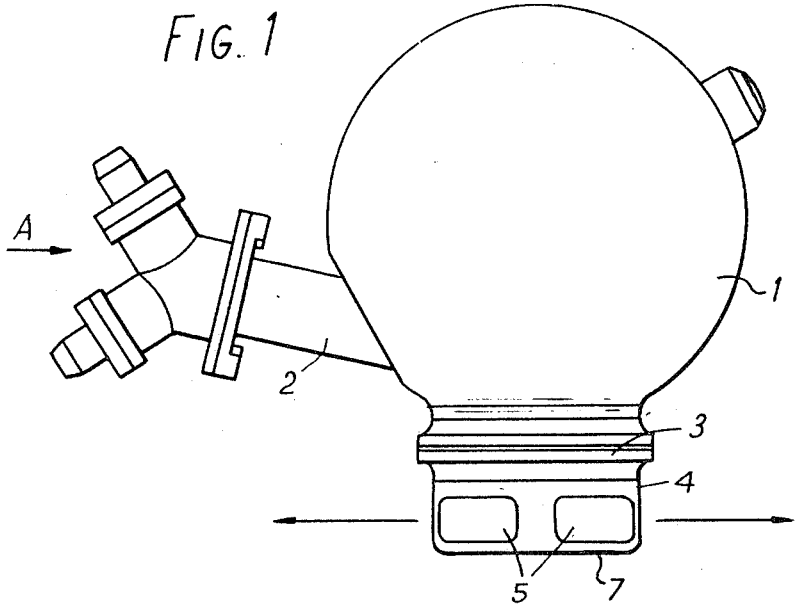
FIG. 1 is a side elevation of a fire extinguisher in accordance with one embodiment of the invention.
Figure 2:
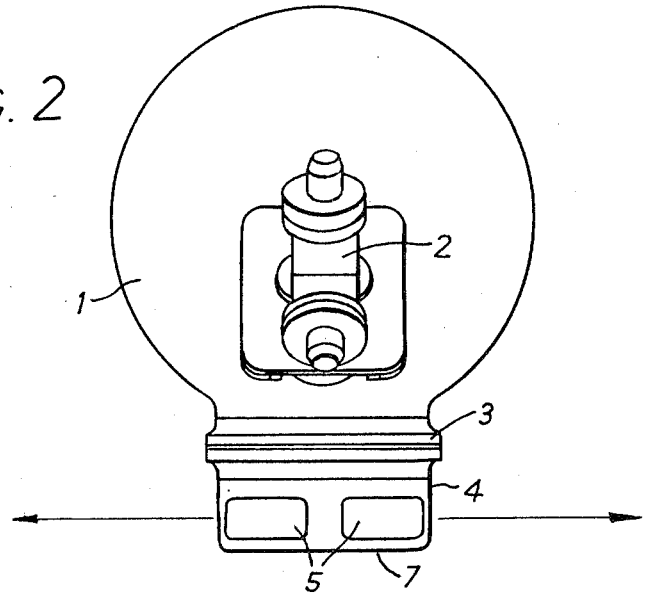
FIG. 2 is a view in the direction of arrow A of FIG. 1.

Referring to FIGS. 1 and 2 of the drawings, a fire extinguisher in accordance with one embodiment of the invention comprises a container in the form of a hollow bulb 1 which defines a chamber for high-pressure extinguishant. Attached to the bulb 1 are a union 2, providing for connection of the extinguisher into an electrical control circuit (described later) and a flanged extinguishant discharge port 3 closed by means of a burstable diaphragm (not shown in FIGS. 1 and 2). In operation, upon receipt of an appropriate control signal via the union 2, the diaphragm closing the discharge port 3 is ruptured, for example by means of a detonator positioned in the bulb 1, to release the contents of the extinguisher.

The discharge port 3 is provided with an end cap 4, having lateral discharge orifices 5 for extinguishant such as "HOLON 1301" which may be further pressurised by $N_2$ or, alternatively according to a feature of the present invention, with $CO_2$ which is quite soluble in this extinguishant and which will expand rapidly on release to boost the surface area of the released extinguishant. Also in accordance with the invention, the end cap 4 provides for deflection of the fire extinguishant through the orifices 5. The discharge orifices 5 are regularly spaced around the periphery of the end cap 4, and thus a 360° radial dispersal of extinguishant is achieved, with substantially zero resultant reaction force being imposed upon the body of the extinguisher.

The end cap provides a wall 7 which is disposed in spaced, facing relationship with the diaphragm closing port 3 and, as can be seen in the drawing, the wall 7 is at least of equal area to said diaphragm. The wall 7 defines an impingement surface 8 against which the extinguishant, exiting the container, strikes, thus generating a substantially equal and opposite force to that generated by the extinguishant on the container as it exits that container.

Figure 3:
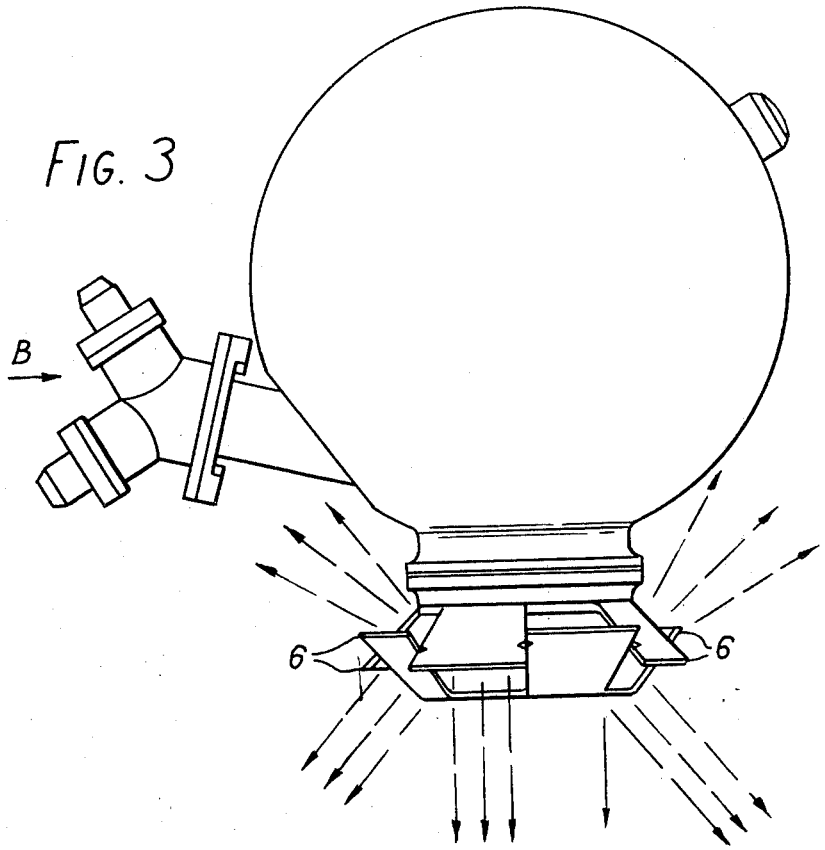
FIG. 3 is a view similar to FIG. 1 of a further embodiment of extinguisher in accordance with the invention.
Figure 4:
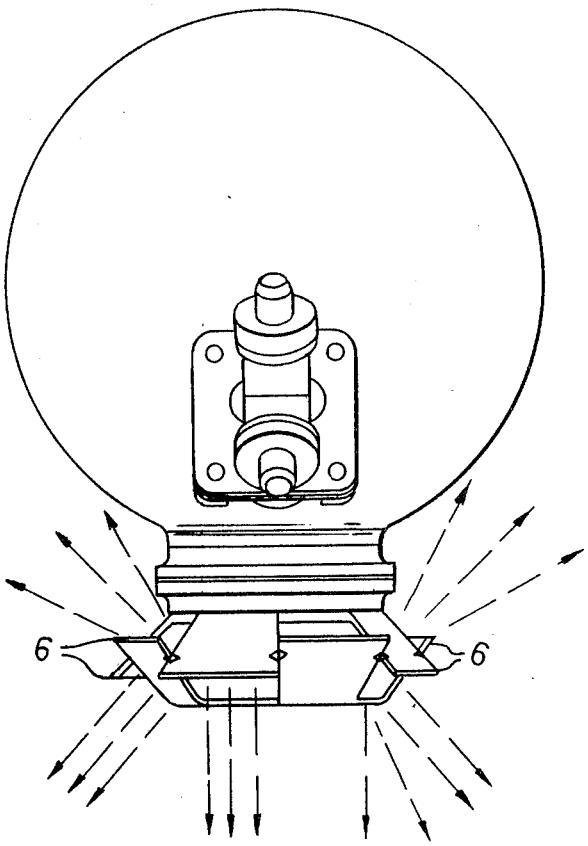
FIG. 4 is a view in the direction of arrow B of FIG. 3.

Although the discharge orifices 5 of the end cap 4 illustrated in FIGS. 1 and 2 are of such relative proportions that a substantially radial 360° distribution of discharged extinguishant is obtained, it will be appreciated that, by adjusting the arrangement and relative dimensions of the discharge orifices, the distribution pattern of the extinguishant can be modified in any desired manner. For example, by increasing the axial length of the orifices 5, a greater dispersion of extinguishant in the axial direction of the end cap 4 can be achieved. Also, as illustrated in FIGS. 3 and 4, auxiliary baffles 6 may be provided for deflection of the extinguishant in an axial direction to provide a wider solid-angle spread.

Figure 5:
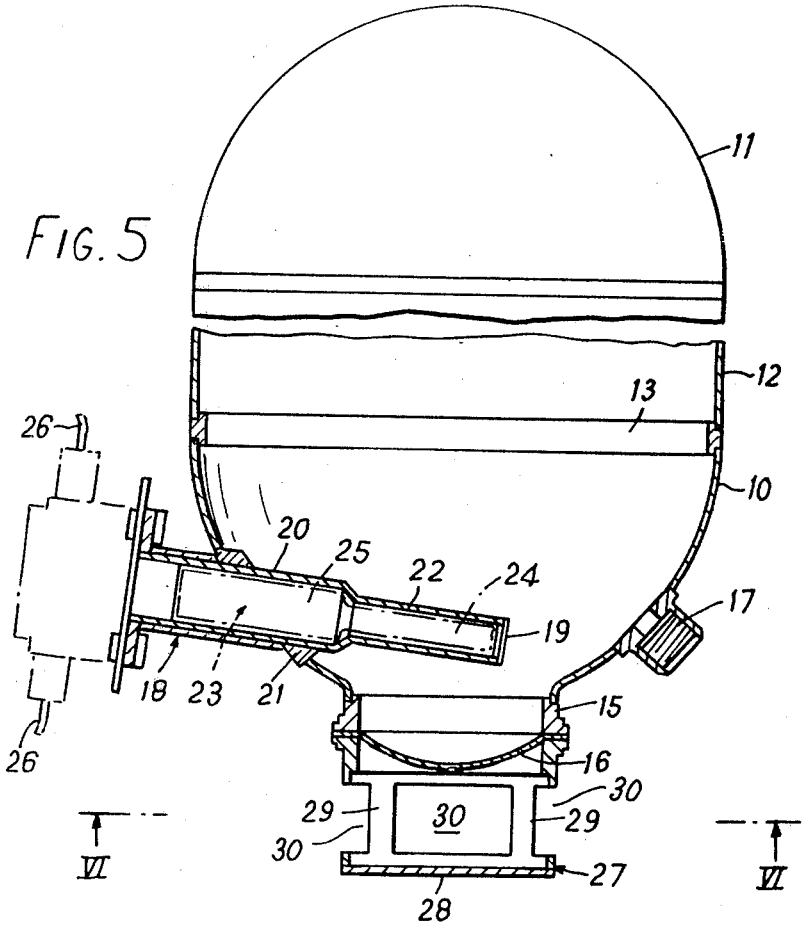
FIG. 5 is a sectional elevation showing a fire extinguisher in accordance with another embodiment of the invention.
Figure 6:
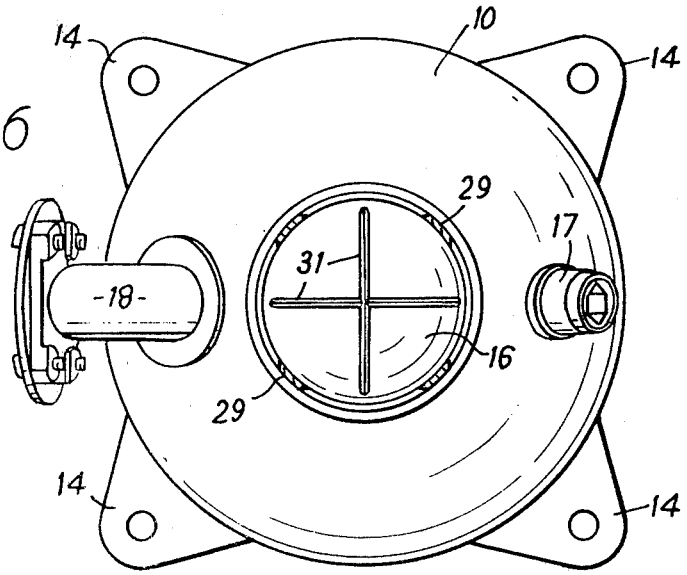
FIG. 6 is a section on the line VI—VI of FIG. 5.

Referring now to FIGS. 5 and 6, the extinguisher is of somewhat larger size than those shown in FIGS. 1 to 4, and comprises a container in the form of two hemispherical ends 10 and 11 hermetically joined by welding to a central tubular part 12. The lower joint is through a ring 13 which carries integral mounting lugs 14.

As better shown in FIG. 5, the lower hemispherical end 10 has a flanged mouth 15 which is closed by a domed metal diaphragm 16 clamped in position around its periphery. The end 10 is also provided with a filling opening 17 and with a detonator well 18. The well is of tubular form reduced in diameter towards its inner end 19 which is closed. Outer length 20 of the well is brazed to a collar 21 which is secured in an opening in the end 10, in such a manner as to provide a hermetic closure for the opening. It will be noted that inner end length 22 of the well is positioned a short distance above the diaphragm 16 and, in use, a detonator device 23 shown in broken lines is inserted into the well so that the detonator 24 itself is located in that end length 22. The detonator is soldered to the end of a carrier part 25 which houses part of an electric circuit for operating the detonator and from which extends conductors 26 for connection to a ring main circuit described later.

The detonator well, and particular its inner length 22, is of course frangible to allow the detonator, on being exploded, to burst the adjacent diaphragm 16.

It will be appreciated that the provision of the detonator well 18 allows the container to be charged prior to and independently of fitting the detonator device 23 in position. Furthermore, if the extinguisher remains unused for a considerable period of time, as a result of which the detonator may be in danger of deteriorating, the detonator device can be removed and electrically tested or replaced without disturbing the pressurised extinguishant, and possibly without removing the extinguisher from its operative location.

As is also shown in FIGS. 5 and 6, an end cap 27 extends from the discharge mouth 15 which is circular and closed by the diaphragm 16 which is also of circular form. The cap carries an impingement wall 28 by means of four integral pillars 29 which extend axially and are regularly spaced to define four lateral discharge orifices 30 which occupy almost all the cylindrical area between the mouth 15 and the wall 28.

The diaphragm 16 is, as shown in FIG. 6, formed with grooves or scores 31 which form lines of weakness crossing at right angles to one another at the centre of the diaphragm. Thus, on exploding the detonator (24), the diaphragm will burst apart into four segments or "petals" and, by positioning the scores 31 mid-way between the pillars 29, the segments of the bursting diaphragm will engage the pillars. As a result, blocking of the orifices 30 by the generally triangular-shaped segments is minimised, and the danger, albeit very limited, of a segment separating from the ruptured diaphragm and passing (at dangerously high speed) through an orifice 30 is greatly reduced. It will also be noted that, as with the wall 7 in FIGS. 1 and 2, the wall 28 is at least equal in diameter to that of the diaphragm 16. This wall thus acts as a barrier to prevent spoil from the detonator 24 and the length 22 of the well 18 being discharged directly from the container.

Figure 7:
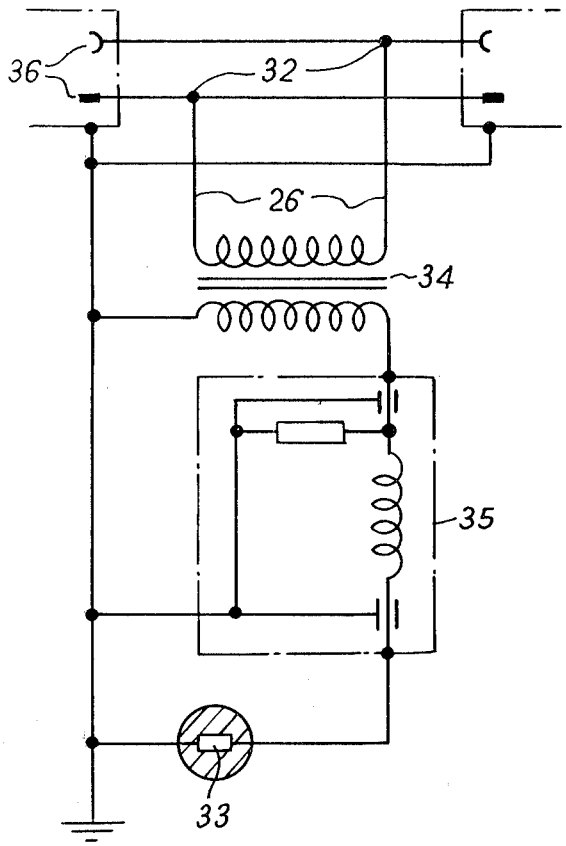
FIG. 7 is an electric circuit diagram of a detonator device.

Referring now to FIG. 7, the aforementioned electric circuit of the detonator device will be described in more detail. Needless to say, it is very undesirable to have any risk of accidental operation of the extinguishers and, with an electrically actuated detonator, risks may arise due to pulses or signals generated by extraneous sources such as lightning or radar. These sources are always in prospect when the extinguishers are mounted in aircraft, and the danger can be increased when the required operating current is small as in the case of a self-generating, possibly piezoelectric, source which is attractive to the present system. Thus, according to the present invention, the conductors 26 from supply terminals 32 are connected to detonator fuse 33 through a circuit which includes a transformer 34 which permits the use of twin-conductor RF-screened cable (as a defence against lightning strike) and to eliminate unwanted DC pulses, and an RF filter 35 to eliminate radar-generated signals.

According to yet a further feature of the present invention, the supply terminals 32 may be connected in a ring circuit indicated at 36 so that fracture of the main circuit at one part may not render the system inoperative.

In yet a further embodiment of the present invention, the container is provided with a plurality of burstable diaphragms which may each have the form of the aforementioned diaphragm 16. The container may be of tubular form, possibly with hemispherical ends as shown in FIGS. 5 and 6, or alternatively with at least one more or less flat end. In this embodiment, the diaphragms close individual discharge ports which are so arranged that discharging flows of extinguishant will balance and produce little or no resultant reaction on the container. For example, and particularly with a tubular container which is generally flat at its lower end, four discharge parts may be arranged regularly around the lower end region and, depending on the dimensions of the extinguisher, it may be possible to burst all four diaphragms by means of a single detonator. An advantage of a construction of this kind is that an extremely rapid discharge rate can be obtained due to the greater aggregate area of the plurality of ports.

In any of the embodiments, the positioning of the discharge ports may be varied. However, it is to be remembered that the discharge rate is usually higher if the detonator is immersed in liquid extinguishant and if the liquid extinguishant discharges before the vapor content which is usually some 50% of the total compressed volume.

I claim:

1. A fire extinguisher comprising a container having a wall which defines a chamber for a source of extinguishant, a diaphragm which is burstable by a detonator device in said container and which permits, upon bursting thereof, a high mass flow rate of extinguishant from the container, and venting means through which extinguishant flowing from the burstable part of the container may be discharged, said venting means including a number of axial pillars defining a plurality of discharge orifices through which extinguishant flowing from the burstable part of the container may be discharged, the number, size and position of said discharge orifices being balanced in such a manner that the reaction forces upon the container due to the flow of extinguishant from the discharge orifices substantially balance one another, and said diaphragm having a center and being formed with a number of lines of weakness which extend outwardly from said center and which promote bursting of said diaphragm into segments, said lines corresponding in number to and being substantially staggered in position in relation to said pillars which will thus be engaged by the segments on bursting of the diaphragm and blocking of said discharge orifices by said segments will be minimized.

2. A fire extinguisher as claimed in claim 1, in which said container wall has an opening and a frangible well extends inwardly from said opening to seal said chamber for the extinguishant and to receive said detonator device in a location adjacent to said burstable diaphragm.

3. A fire extinguisher as claimed in claim 2, in which said extinguishant is partly in the liquid phase and said frangible well extends to a lower part of said chamber to be substantially immersed in extinguishant liquid.

4. A fire extinguisher as claimed in claim 2 or claim 3, in which said well comprises an elongated tube comprising an outer length which is secured in said opening and an inner length in which said detonator is accommodated.

5. A fire extinguisher as claimed in claim 1 or claim 2 and further comprising wall means arranged in spaced, facing relationship to said diaphragm and being at least substantially equal in area to said diaphragm whereby said wall means provides an impingement surface for a jet of extinguishant released upon bursting of said diaphragm, and means locating said wall means in fixed relation to said container whereby the reaction force upon said container due to the discharge of the jet of extinguishant therefrom is substantially balanced by the reaction force on said wall means due to impingement of the jet extinguishant thereon, the said locating means defining lateral outlet means between said diaphragm and said impingement surface, and said outlet means extending over the major part of the peripheral space between said diaphragm and said impingement surface and constituting means permitting substantially unimpeded and balanced dispersal of extinguishant deflected by said impingement surface.

6. A fire extinguisher as claimed in claim 1 or claim 2, in which said diaphragm and said wall means are both of circular form having substantially equal diameters.

7. A fire extinguisher as claimed in claim 1 or claim 2, in which said diaphragm is of a circular form and said lines of weakness follow two diameters at right angles to one another.

8. A fire extinguisher as claimed in claim 1 or claim 2, and further comprising an electrical circuit through which the detonator is operated, said electric circuit including a transformer and an RF filter to minimize the danger of accidental operation on receipt of a pulse or signal generated by an extraneous source.

9. A fire extinguisher as claimed in claim 8 in which said electrical circuit is connected in an electrical ring to reduce the danger of failure.

10. A fire extinguisher as claimed in claim 1 or claim 2, in which said extinguishant is additionally pressurized by a medium which is at least partly soluble therein.

11. A fire extinguisher as claimed in claim 10 in which said medium is carbon dioxide.

* * * * *